US011719485B2

(12) United States Patent
Yoo

(10) Patent No.: US 11,719,485 B2
(45) Date of Patent: Aug. 8, 2023

(54) REFRIGERATOR

(71) Applicant: LG Electronics Inc., Seoul (KR)

(72) Inventor: Jeongwon Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 49 days.

(21) Appl. No.: 17/223,872

(22) Filed: Apr. 6, 2021

(65) Prior Publication Data

US 2021/0404729 A1 Dec. 30, 2021

(30) Foreign Application Priority Data

Jun. 26, 2020 (KR) ..... 10-2020-0078304

(51) Int. Cl.

| | |
|---|---|
| ***F25D 23/00*** | (2006.01) |
| ***F25B 39/04*** | (2006.01) |
| ***F25D 19/00*** | (2006.01) |
| ***F28D 1/047*** | (2006.01) |
| ***F28D 21/00*** | (2006.01) |

(52) U.S. Cl.

CPC ..... *F25D 23/003* (2013.01); *F25B 39/04* (2013.01); *F25D 19/00* (2013.01); *F28D 1/0476* (2013.01); *F25B 2339/04* (2013.01); *F28D 2021/007* (2013.01)

(58) Field of Classification Search

CPC ..... F25D 3/003; F25D 19/00; F25B 2339/04; F28D 2021/007

See application file for complete search history.

(56) References Cited

U.S. PATENT DOCUMENTS

| | | | | |
|---|---|---|---|---|
| 5,749,412 | A | 5/1998 | Balthazard | |
| 2014/0007612 | A1 | 1/2014 | Kim et al. | |
| 2016/0069595 | A1* | 3/2016 | Kim | F25B 13/00 62/498 |

FOREIGN PATENT DOCUMENTS

| | | | |
|---|---|---|---|
| CN | 101776357 | | 7/2010 |
| CN | 103528304 | | 1/2014 |
| CN | 106871498 | | 6/2017 |
| CN | 106871498 A | * | 6/2017 |

(Continued)

OTHER PUBLICATIONS

CN-106871498-A Translation.*

(Continued)

*Primary Examiner* — Elizabeth J Martin

(74) *Attorney, Agent, or Firm* — Fish & Richardson P.C.

(57) ABSTRACT

A refrigerator includes a cabinet that defines a storage space and a machine compartment that accommodates a compressor, a blow fan, and a condenser. The condenser is curved along front, rear, and side surfaces of the machine compartment. The condenser includes a first header disposed at a first end of the condenser, a second header disposed at a second end of the condenser, tubes that connect the first header and the second header to each other, heat exchange fins disposed the tubes, an input connection portion that extends from the first header toward the second header and is configured to supply refrigerant to the first header, and an output connection portion that extends from the first header toward the second header and is spaced apart from the input connection portion. The output connection portion is configured to receive the refrigerant discharged from the first header.

19 Claims, 7 Drawing Sheets

(56) References Cited

FOREIGN PATENT DOCUMENTS

| | | | | |
|---|---|---|---|---|
| CN | 106959037 | | | 7/2017 |
| CN | 209893745 | | | 1/2020 |
| CN | 111609627 | A | * | 9/2020 |
| JP | H 11114668 | A | * | 9/1997 |
| JP | H11114668 | | | 4/1999 |
| KR | 1020140006680 | | | 1/2014 |
| KR | 20170024883 | | | 3/2017 |
| KR | 20180138488 | | | 12/2018 |

OTHER PUBLICATIONS

JPH 11114668A translation.*
CN-111609627-A translation.*
Extended European Search Report in European Appln. No. 21175214.2, dated Nov. 2, 2021, 11 pages.
Office Action in Chinese Appln. No. 202110521054.2, dated Oct. 9, 2022, 17 pages (with English translation).

* cited by examiner

REFRIGERATOR

CROSS-REFERENCE TO RELATED APPLICATIONS

This application claims the benefit of the Korean Patent Application No. 10-2020-0078304, filed on Jun. 26, 2020, which is hereby incorporated by reference as if fully set forth herein.

TECHNICAL FIELD

The present disclosure relates to a refrigerator.

BACKGROUND

A refrigerator is a home appliance that may store food at low temperatures in an internal storage space covered by a door. For example, the refrigerator may keep the stored food in an optimal state by cooling the inside of the storage space using cold air generated through heat exchange with a refrigerant circulating in a refrigeration cycle.

In some cases, a refrigerator may include a machine compartment that is provided apart from the storage space to accommodate components such as a compressor and a condenser for driving the refrigeration cycle. The machine compartment may include an internal space defining a flow path of cooling air for cooling the components inside the machine compartment.

The machine compartment may be a space separated from the storage space in the refrigerator, and as a volume of the machine compartment increases, a capacity of the storage space in the refrigerator decreases. In some cases, to minimize the space of the machine compartment, the compressor and the condenser may have reduced sizes, while maintaining performance and efficiency thereof.

In some cases, a refrigerator may include heat exchanges units having a plurality of rows that are efficiently arranged in a limited internal space of a machine compartment. For instance, an internal space of a machine compartment may be efficiently utilized using a parallel flow condenser with one side bent.

In some cases, an inlet and an outlet connected to an inlet header and an outlet header of a condenser may be seated to face a blow fan. In such a mounting structure of the condenser, it may be difficult to work due to insufficient space for connecting or assembling various devices performing heat exchange in the internal space of the machine compartment.

For example, after the arrangement of the internal components of the machine compartment, a welding operation for connecting a refrigerant pipe connected to a compressor, a condenser, and an evaporator, or the like may be performed. A small inner space of the machine compartment may limit such operations and cause damage to other components during the operations. In addition, the small inner space may limit device connection and separation in service activities for repair or maintenance of the condenser or the machine compartment.

In some cases, an increase in the volume inside the machine compartment may degrade insulation performance of the refrigerator or cause loss of storage capacity.

SUMMARY

The present disclosure describes a refrigerator having a space for facilitating installation and maintenance work of components inside a machine compartment, while a volume of the machine compartment is maintained.

The present disclosure also describes a refrigerator having an increased internal capacity, while a working space in a machine compartment is secured, by minimizing the space of the machine compartment.

The present disclosure further describes a refrigerator that facilitates assembly and a service.

According to one aspect of the subject matter described in this application, a refrigerator includes a cabinet that defines a storage space and a machine compartment therein, where the machine compartment is separate from the storage space and accommodates a compressor, a blow fan, and a condenser. The condenser is curved along front, rear, and side surfaces of the machine compartment. The condenser includes a first header disposed at a first end of the condenser, a second header disposed at a second end of the condenser, a plurality of tubes that connect the first header and the second header to each other, a plurality of heat exchange fins that are disposed between the plurality of tubes, an input connection portion that extends from the first header toward the second header and is configured to supply refrigerant to the first header, and an output connection portion that extends from the first header toward the second header and is spaced apart from the input connection portion. The output connection portion is configured to receive the refrigerant discharged from the first header.

Implementations according to this aspect can include one or more of the following features. For example, the condenser can include a pair of linear portions that are spaced apart from each other and extends parallel to each other, where the pair of linear portions include the first header and the second header, respectively. The condenser can further include a bent portion that connects the pair of linear portions to each other, where the input connection portion and the output connection portion extend perpendicular to the pair of linear portions.

In some implementations, the second header can be disposed forward relative to the first header, and the input connection portion can extend forward from an upper portion of the first header toward the second header, where the input connection portion is curved into an inner space defined by the plurality of tubes that are bent and connect between the first header and the second header. In some examples, the output connection portion can extend forward from a lower portion of the first header toward the second header, where the output connection portion is curved into an inner space defined by the plurality of tubes that are bent and connect between the first header and the second header.

In some implementations, the input connection portion can have a first end connected to the first header and a second end that faces the second header. In some implementations, the output connection portion a first end connected to the first header and a second end that faces the second header.

In some implementations, the blow fan can be disposed between the compressor and the condenser and extend parallel to the input connection portion and the output connection portion. In some examples, the input connection portion and the output connection portion can be located outside a space defined between the blow fan and the condenser.

In some implementations, the refrigerator can further include an input pipe that connects the compressor to an end of the input connection portion. In some implementations, the refrigerator can further include an output pipe connected to an end of the output connection portion, and an expansion device connected to the output pipe.

In some implementations, the plurality of tubes can be inserted into the first header along a first direction, where the input connection portion and the output connection portion are connected to the first header along a second direction perpendicular to the first direction.

In some implementations, the plurality of tubes can include an inclined surface that is inserted into the first header. In some examples, the inclined surface can be inclined by 30° to 60° with respect to an extension direction of the input connection portion or the output connection portion. In some examples, a distance between a rear end of the inclined surface and the blow fan can be less than a distance between a front end of the inclined surface and the blow fan. In some examples, the inclined surface has a contact area that is in contact with an inner side of the first header and that is disposed rearward relative to a rear side of the output connection portion or the input connection portion.

According to another aspect, a condenser includes a pair of linear portions that are spaced apart from each other and extend parallel to each other, where the pair of linear portions include a first header disposed at a first end of the condenser and a second header disposed at a second end of the condenser. The condenser further includes a bent portion that connects the pair of linear portions to each other, where the bent portion includes a plurality of tubes that are bent and connect the first header and the second header to each other. The condenser further includes a plurality of heat exchange fins disposed between the plurality of tubes, an input connection portion that extends from the first header toward the second header and that is configured to supply refrigerant to the first header, and an output connection portion that extends from the first header toward the second header and is spaced apart from the input connection portion. The output connection portion is configured to receive the refrigerant discharged from the first header.

Implementations according to this aspect can include one or more of the following features and the features of the condenser described above. For example, the input connection portion and the output connection portion can be connected to the first header along a direction perpendicular to an extension direction of the pair of linear portions. In some examples, parts of the input connection portion and the output connection portion can be located in an inner space defined by the plurality of tubes in the bent portion.

In some implementations, the plurality of tubes comprise an inclined surface that is inserted into the first header. In some examples, the inclined surface can be inclined by 30° to 60° with respect to an extension direction of the input connection portion or the output connection portion. . . .

In some implementations, the input connection portion for supplying refrigerant and the output connection portion for discharging the refrigerant are vertically spaced apart from each other, and the input connection portion and the output connection portion extend from the first header toward the second header. That is, the input connection portion and the output connection portion can be provided in an inner space defined by bending the condenser.

Accordingly, the input connection portion and the output connection portion may not be located in the space between the blow fan unit and the condenser, thereby improving space efficiency of the machine compartment. In addition, it may be possible to additionally secure a working space for welding, screw fastening, etc. through the space between the blow fan unit and the condenser.

In some examples, the tube can have an inclined surface inserted into the first header and inclined at a certain angle with respect to the input connection portion or output connection portion such that a refrigerant can flow while flow loss is minimized. For example, a cross-section of the tube has the inclined surface inclined to the output connection portion such that the refrigerant discharged from the tube can flow to the output connection portion, while flow resistance is minimized.

DETAILED DESCRIPTION

Hereinafter, one or more implementations of the present disclosure will be described in detail together with the drawings. However, the present disclosure is not limited to the implementations in which the spirit of the present disclosure is presented, and any other degenerative disclosure or any other implementations within the scope of the present disclosure can be easily proposed by adding, modifying, or deleting other components.

Figure 1:
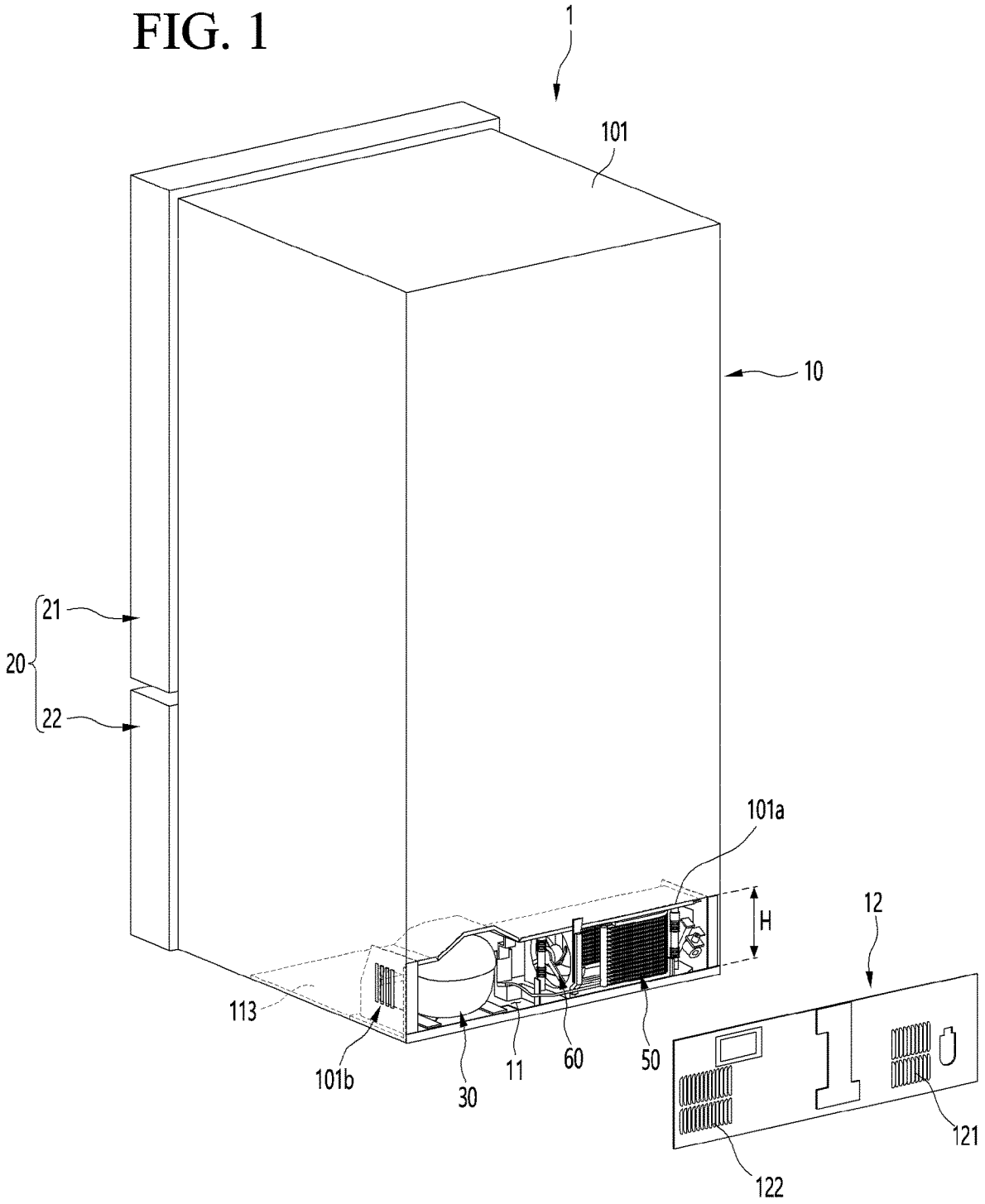
FIG. 1 is a perspective view showing an example of a machine compartment that is open at a rear side of a refrigerator.
Figure 2:
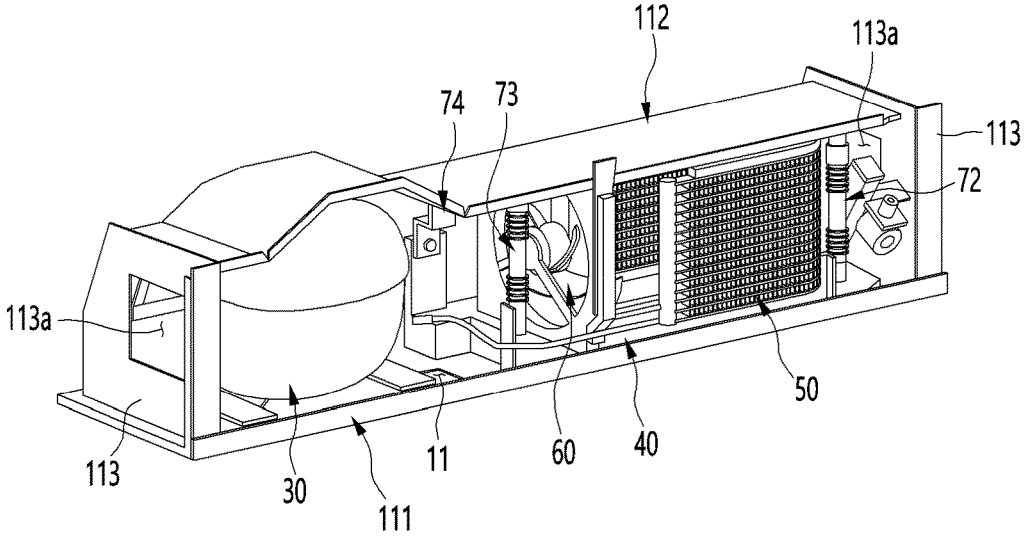
FIG. 2 is a perspective view showing an example of an internal structure of the machine compartment.
Figure 3:
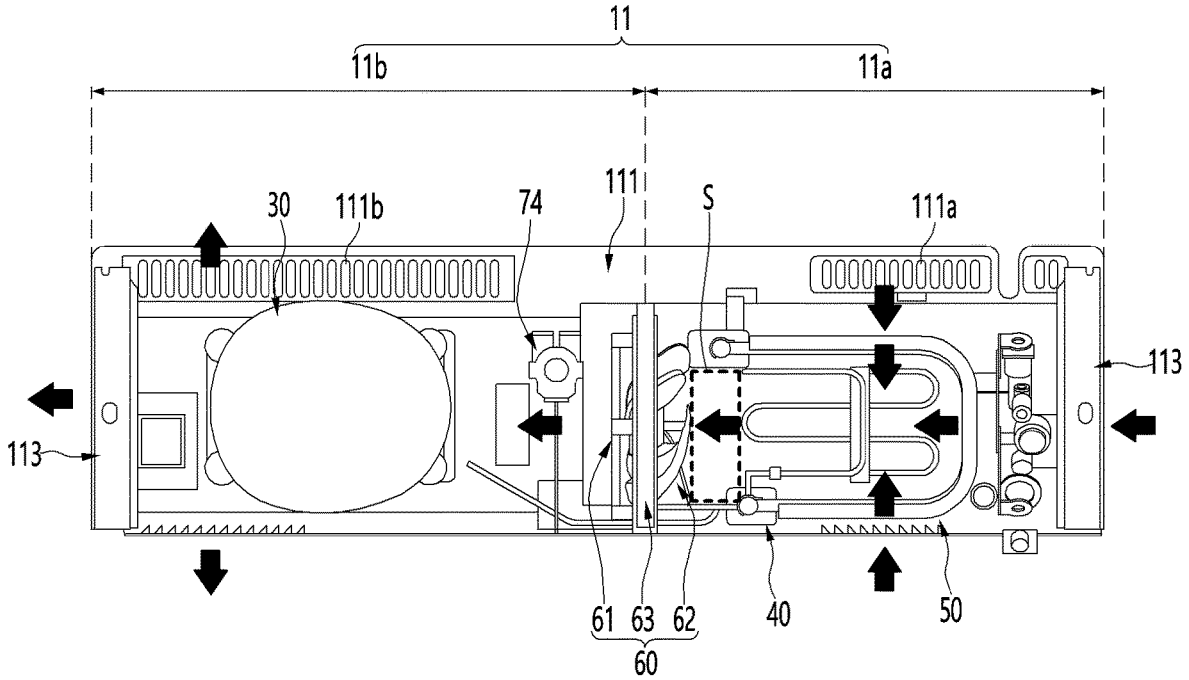
FIG. 3 is a plan view showing an example of air flow in the machine compartment.

FIG. 1 is a perspective view showing an example of a refrigerator having a machine compartment that is open at a rear side of the refrigerator. FIG. 2 is a perspective view showing an example of an internal structure of the machine compartment. FIG. 3 is a plan view showing an example of air flow in the machine compartment.

Hereinafter, for the convenience of understanding of the description, a direction toward a door 20 is defined as a front side and a direction toward a machine compartment cover 12 shielding a machine compartment opening 101*a* is defined as a rear side.

In some implementations, a refrigerator 1 can include a cabinet 10 that defines a storage space, and a door 20 configured to open and close the storage space.

The storage space can include a plurality of spaces that are divided horizontally or vertically and cooled to different temperatures so as to be used as a refrigerating compartment or a freezing compartment.

In some examples, the door 20 can be configured to open and close each of the plurality of storage spaces. In addition, the door 20 can be mounted at the cabinet 10 so as to be rotatably or slidably drawn in and out and can independently open or close each storage space. In some implementations, a case in which the storage space is divided vertically and the door 20 includes an upper door 21 and a lower door 22 will be described as an example.

In some examples, a cabinet 10 can include an outer case 101 forming an exterior and an inner case forming the storage space inside the outer case 101. In addition, an insulating material can fill a gap between the outer case 101 and the inner case to insulate the storage space.

In some implementations, a machine compartment 11 can be provided at a lower end of the rear of the cabinet 10. The machine compartment 11 includes components constituting a refrigeration cycle for cooling the storage space to form a space in which a plurality of electrical components are disposed, and can be partitioned from the storage space to form an independent space. In addition, the machine compartment 11 can be in communication with an external space so that components inside the machine compartment 11 can be cooled or heat-exchanged.

In detail, a bottom surface of the machine compartment 11 can be formed by a bottom plate 111. The bottom plate 111 can be provided with a compressor 30 for compressing and supplying a refrigerant at high temperature and high pressure, a condenser 50 for dissipating heat of the high temperature and high pressure refrigerant supplied from the compressor 30, and a blow fan unit 60 for forcibly causing air inside the machine compartment 11 to flow. The compressor 30, the condenser 50, and the blow fan unit 60 can be directly or indirectly mounted on the bottom plate 111.

Based on the blow fan unit 60, the inside of the machine compartment 11 can be divided left and right, and as shown in FIG. 1, the condenser 50 is disposed on the right and the compressor 30 is disposed on the left. The region on the right side where the condenser 50 is disposed can be referred to as an intake part 11*a* through which outside air is intaken, and the region on the left side where the compressor 30 is disposed can be referred to as a discharge part 11*b* through which outside air is discharged.

A machine compartment cover 12 can be mounted in a machine compartment opening 101*a* formed on a rear surface of the machine compartment 11. The machine compartment cover 12 can form the exterior of the rear of the machine compartment 11 and a part of the rear of the refrigerator 1 and shield the machine compartment opening 101*a* to prevent the components inside the machine compartment 11 from being exposed to the outside.

The height H of the machine compartment opening 101*a* can have a height corresponding to a height of an upper end of the condenser 50. A lower surface of the machine compartment 11 can be formed by the bottom plate 111, and an upper surface including a front surface of the machine compartment 11 can be formed by a top plate 112. In addition, the height H of the opening of the machine compartment 11 can be defined by a distance between a rear end of the bottom plate 111 and a rear end of the top plate 112 and can be equal to or substantially equal to a height of the condenser 50.

That is, when the machine compartment cover 12 is opened, the machine compartment opening 101*a* can be exposed to the outside, and at this time, the condenser 50 can be slidably drawn in and out in a front-rear direction so as to be installed and disassembled, and the condenser 50 can be separated or mounted through the machine compartment opening 101*a*. Therefore, even if the height H of the machine compartment opening 101*a* is substantially the same as the height of the condenser 50, the height and space of the machine compartment 11 can be minimized without interference during assembly and disassembly for service.

In some examples, the machine compartment cover 12 can be formed with an inlet 121 through which external air is intaken and an outlet 122 through which air inside the machine compartment 11 is discharged to the outside. The inlet 121 can be formed at a position corresponding to the condenser 50, and the outlet 122 can be formed at a position corresponding to the compressor 30. The outlet 122 and the inlet 121 can be formed in a grille shape including a plurality of holes and can be formed to be inclined or rounded so that intaken and discharged air can have directionality.

In addition, a cabinet inlet and a cabinet outlet 101*b* can be formed on both sides of the cabinet 10 corresponding to both sides of the machine compartment 11. The cabinet inlet, as a passage through which external air is intaken, can be formed to communicate with the intake part 11*a*, that is, a region in which the condenser 50. The cabinet outlet 101*b*, as a passage through which the air inside the machine compartment 11 is discharged to the outside, can be formed to communicate with the discharge part 11*b*, that is, a region in which the compressor 30 is disposed.

Side frames 113 forming side surfaces of the machine compartment 11 can be provided on both left and right sides of the bottom plate 111. In addition, a frame inlet 113*a* and a frame outlet 113*b* can be formed in the side frame 113. Here, the frame inlet 113*a* can be opened at a position corresponding to the cabinet inlet to communicate with each other, and the frame outlet 113*b* can be opened at a position corresponding to the cabinet outlet 101*b* to communicate with each other.

In addition, a plate inlet 111*a* and a plate outlet can be formed at the bottom plate 111 forming a bottom surface of the machine compartment 11. The plate inlet 111*a* can be formed at a region of the intake part 11*a* and can be horizontally elongated at a front end of the bottom plate 111. In addition, the plate outlet 111*b* can be formed at a region of the discharge part 11*b* and can be horizontally elongated at a front end of the bottom plate 111.

As shown in FIG. 3, inside the machine compartment 11, the intake part 11*a* and the discharge part 11*b* are disposed on the left and right by the blow fan unit 60 as a whole and air can be intaken and discharged three-dimensionally.

In detail, external air can be forcibly intaken through the inlet 121 at the front, the plate inlet 111*a* at the rear, and the cabinet inlet on the side based on the condenser 50 and flow to the inside of the intake part 11*a* and can pass through the front surface, the rear surface, and the side surface of the condenser 50 formed along the inner circumference of the intake part 11*a*. That is, external air passes evenly over the entire surface of the condenser 50 so that heat from the condenser 50 can be effectively dissipated.

Also, air inside the machine compartment 11 can cool the compressor 30 through the front outlet 122, the rear plate outlet 111*b*, and the side cabinet outlet 101*b* based on the compressor 30 and can be subsequently discharged to the outside. That is, air discharged by the blow fan unit 60 can cool the compressor 30, while passing through the compressor 30 at the side, and can be discharged to the front, rear and side of the discharge part 11*b*.

In this manner, while external air is three-dimensionally supplied to the intake part 11*a* according to the operation of the blow fan unit 60, heat from the condenser 50 is dissipated, the compressor 30 is three-dimensionally cooled, and the air can then be discharged to the outside through the discharge part 11*b*.

In addition, a base pan 40 on which the condenser 50 is mounted can be provided on the bottom plate 111.

Figure 4:
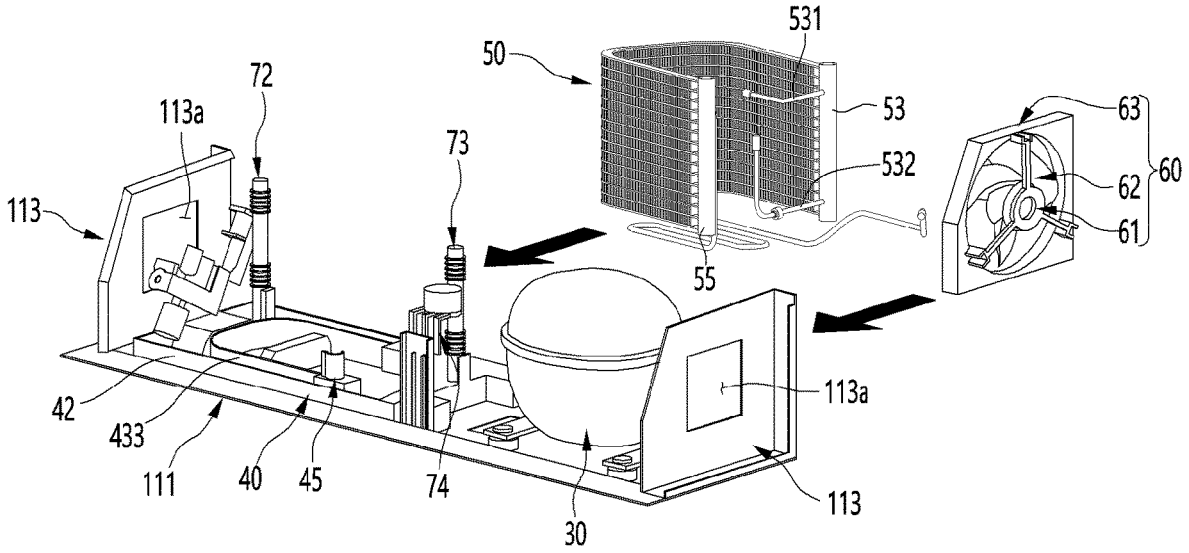
FIG. 4 is an exploded perspective view showing an example condenser and an example blow fan that are disposed in the machine compartment and spaced apart from each other.

FIG. 4 is an exploded perspective view showing a separated state of the condenser and the blow fan in the machine compartment.

As shown in the drawings, the bottom plate 111 can be formed in a planar shape to form the bottom surface of the machine compartment 11. In addition, side frames 113 can be formed at both left and right ends of the bottom plate 111. The side frame 113 can form a side surface of the machine compartment 11 and can be coupled to both side ends of the top plate 112. In addition, the frame inlet 113*a* and the frame outlet 113*b* can be formed at the center of the side frame 113.

In addition, the base pan 40 can be mounted on the bottom plate 111. The base pan 40 can be located in a region of the intake part 11*a* in which the condenser 50 is mounted among both left and right sides. In addition, the condenser 50 and the blow fan unit 60 can be mounted at an upper surface of the base pan 40.

The condenser 50 and the base pan 40 are configured to be easily separated and mounted through the machine compartment opening 101*a* for service even after the machine compartment 11 is assembled and mounted in the cabinet 10. In particular, the condenser 50 and the base pan 40 can be moved in and out of the machine compartment 11 in a front-rear direction through the machine compartment opening 101*a*. Therefore, the machine compartment 11 may not include a separate extra space for separate mounting of the condenser 50 and the blow fan 62 on the upper side, and thus the machine compartment 11 can have a minimum height and a minimum volume.

The blow fan unit 60 can include a blow fan 62, a fan motor 61 for rotating the blow fan 62, and a fan guide 63 in which the blow fan 62 and the fan motor 61 are disposed.

In some examples, the blow fan unit 60 can be mounted on the base pan 40 in an assembled state. Here, the blow fan unit 60 can be inserted into the machine compartment 11 in an inclined state to avoid interference with refrigerant pipes extending from the compressor 30 to the condenser 50 and can be mounted at a blow fan unit mounting part 47 by horizontally moving a lower end of the fan guide 63 inside the machine compartment 11.

In particular, the base pan 40 can be provided with fixing portions 45 and 46 that allow the condenser 50 to be detached and attached, while sliding in the front-rear direction. Accordingly, the condenser 50 can be mounted and removed very easily even in the machine compartment 11 narrow in height.

Hereinafter, a structure of the condenser 50 and the base pan 40 will be described in more detail with reference to the drawings.

Figure 5:
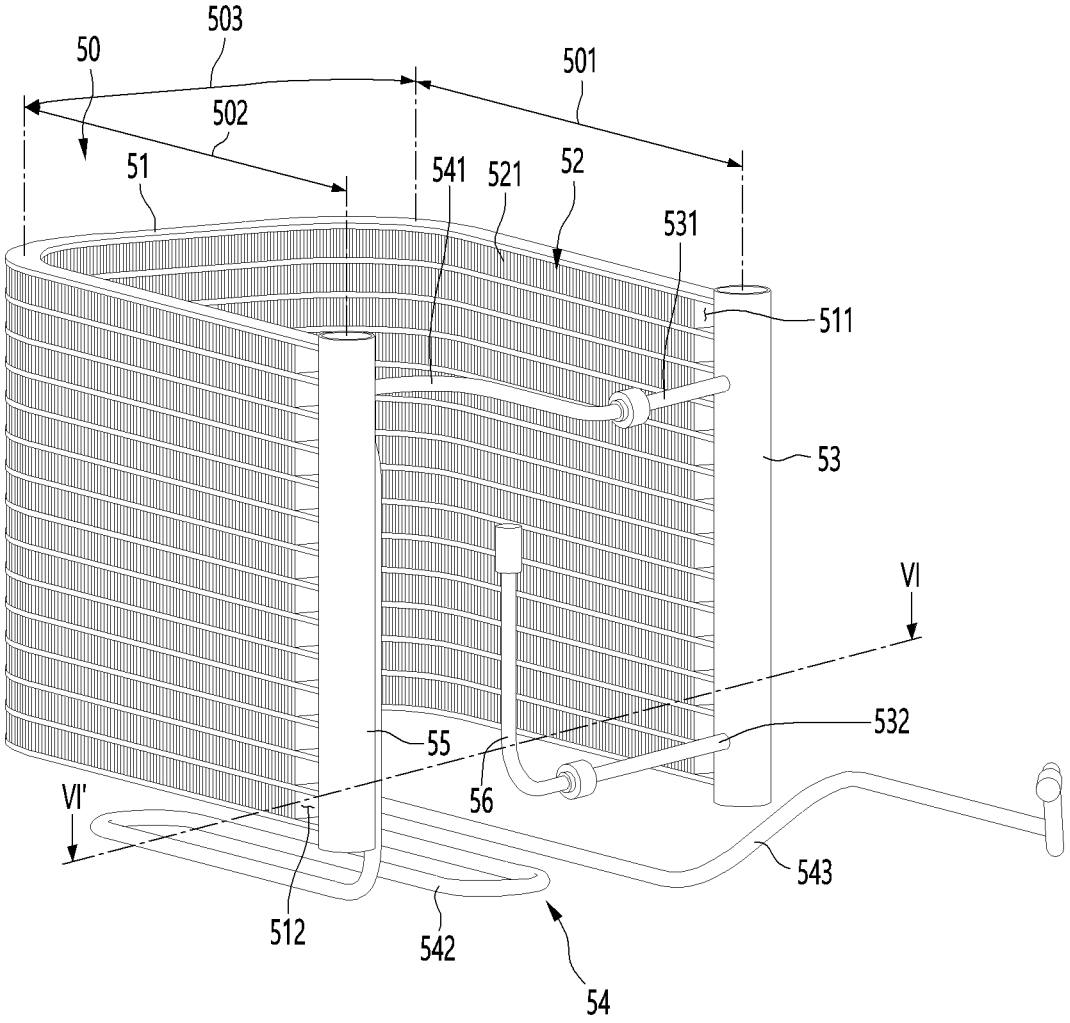
FIG. 5 is a perspective view of the condenser.
Figure 6:
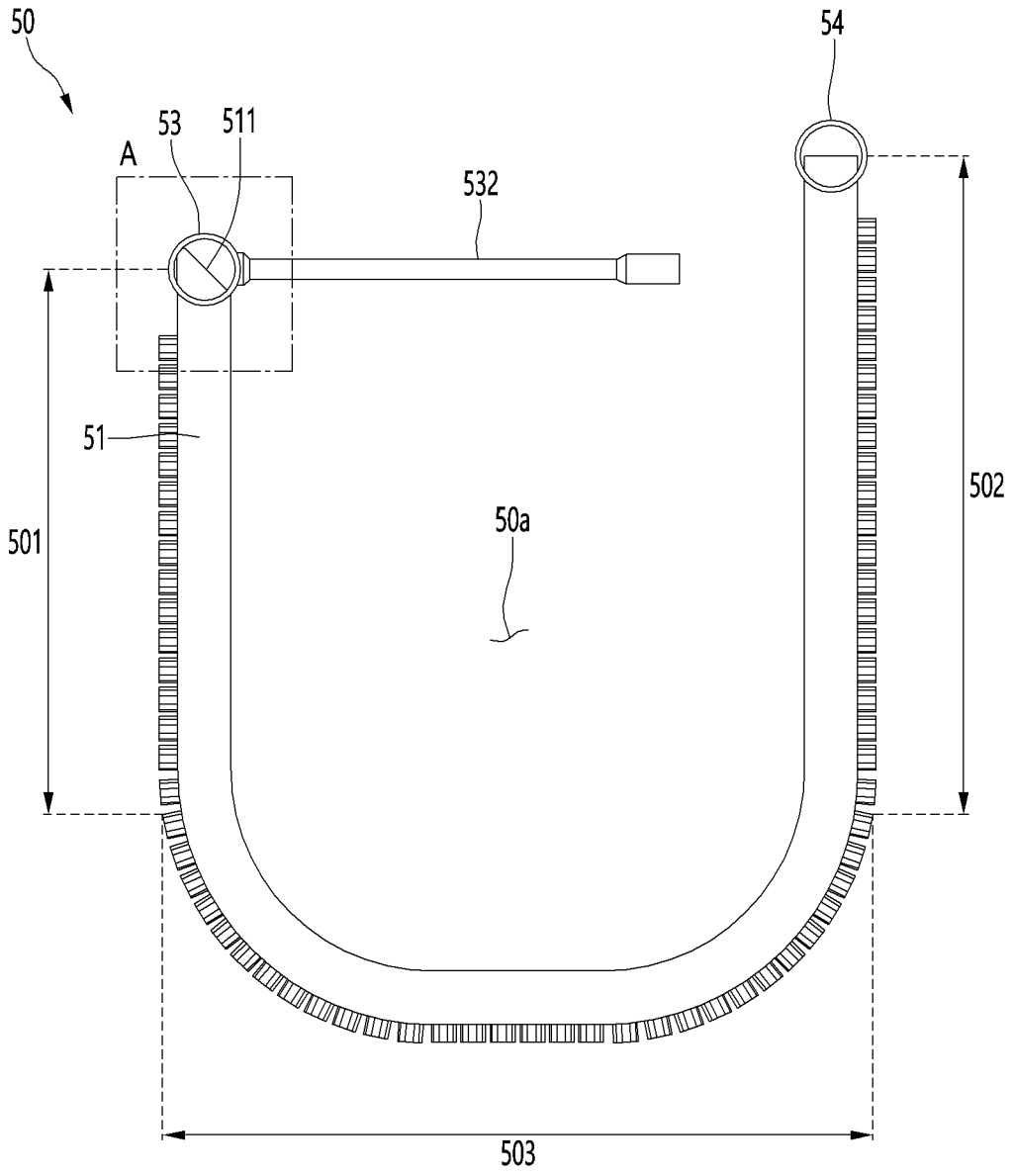
FIG. 6 is a cross-sectional view taken along line VI-VI' of FIG. 5.
Figure 7:
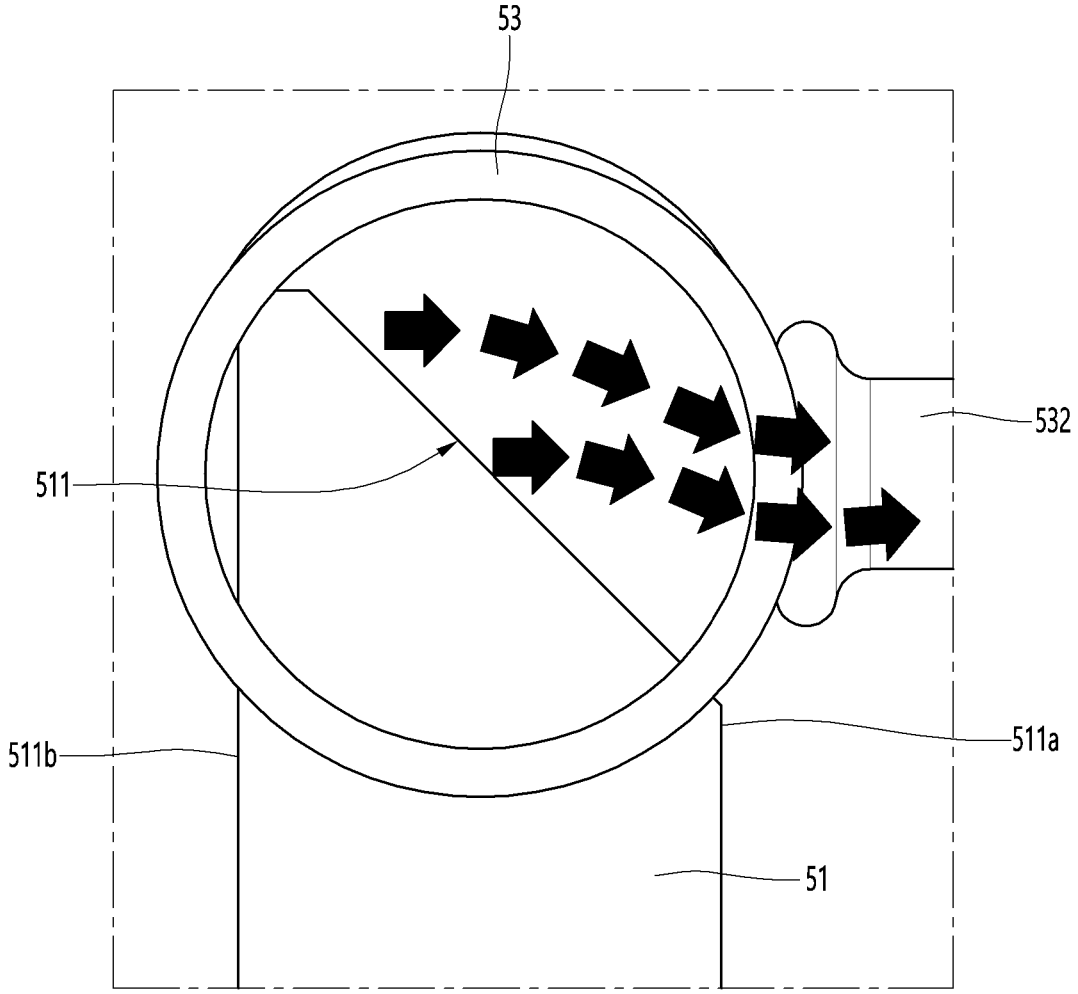
FIG. 7 is a view showing flow of air to enlarged portion A of FIG. 6.
Figure 8:
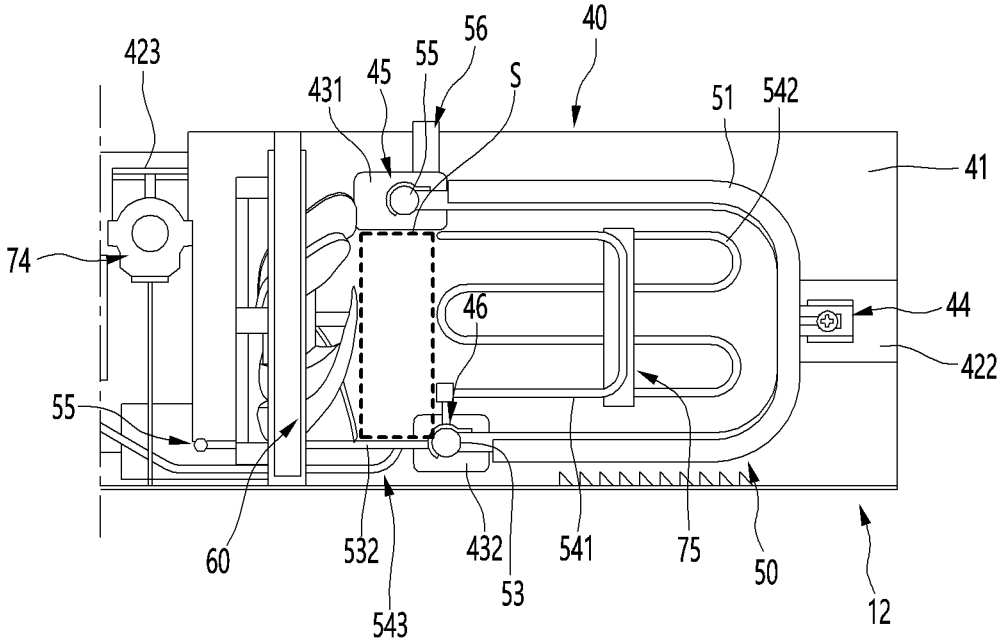
FIG. 8 is a plan view showing an example state of the condenser that is mounted to the machine compartment.

FIG. 5 is a perspective view of the condenser. FIG. 6 is a cross-sectional view taken along line VI-VI' of FIG. 5. FIG. 7 is an enlarged view of portion A of FIG. 6, illustrating an example flow of air. FIG. 8 is a plan view showing an example state in which the condenser is mounted.

As shown in the drawings, the condenser 50 can include a first linear portion 501 extending in parallel with the machine compartment cover 12 from a rear surface of the machine compartment 11, that is, a position facing the machine compartment cover 12, a second linear portion 502 disposed in parallel with the first linear portion 501 at a position spaced apart from the first linear portion 501, and a bent portion 503 connecting ends of the first linear portion 501 and the second linear portion 502 and formed at a position facing a side surface of the machine compartment 11. That is, the condenser 50 can have a bent or curved shape along the front, rear and side surfaces of the intake part 11*a*. For example, the curved shape can include being bent to be curved.

In addition, the condenser 50 is formed to extend from the base pan 40 to an upper end of the machine compartment 11 in an up-down direction. Accordingly, air intaken in each direction toward the inside of the intake part 11*a* can entirely pass through the condenser 50 and can be directed to the blow fan unit 60.

In detail, the condenser 50 can include a pair of a first header 53 and a second header 55, a tube 51 connecting the first header 53 and the second header 55, and heat exchange fins 52 connecting the tubes 51 disposed above and below. Such a configuration is generally referred to as a micro channel condenser, can have a relatively compact size, and can have excellent heat exchange performance.

In some examples, the first header 53 and the second header 55 can be spaced apart from each other in the front-rear direction and can be elongated in the up-down direction at the same height. The first header 53 and the second header 55 can be connected to both ends of the plurality of tubes 51, respectively, and can have a partition wall therein to determine a flow path of a refrigerant flowing along the plurality of tubes 51.

In the first header 53, an input connection portion 531 for supplying a refrigerant to the condenser 50 and an output connection portion 532 for discharging the refrigerant from the condenser 50 can be vertically disposed. In addition, an input pipe 54 connected to the compressor 30 can be connected to the input connection portion 531, and an output pipe 56 connected to an expansion device 74 can be connected to the output connection portion 532. In some examples, the input connection portion 531 and the output connection portion 532 can include a tube or a pipe.

The input connection portion 531 and the output connection portion 532 can be provided to be spaced apart in the up-down direction on the first header 53, and the input connection portion 531 and the output connection portion 532 can extend from the first header 53 toward the second header 55.

In detail, the input connection portion 531 is connected to an upper portion of the first header 53 and extends forward from the front side of the first header 53 and traverse an inner space 50*a* formed as the condenser 50 is bent. In addition, an end of the input connection portion 531 can be disposed at a position facing the second header 55.

That is, the input connection portion 531 is connected to the first header 53 and extends linearly toward the second header 55. The input connection portion 531 does not extend toward the side of the first header 53, that is, in a direction in which the blow fan unit 60 is mounted.

In other words, the input connection portion 531 extends forward in parallel with the blow fan unit 60 from the front of the first header 53 so as to be provided in the inner space 50*a* of the condenser 50. In addition, the input connection portion 531 can be formed to be perpendicular to the first and second linear portions 501 and 502 and can be formed in parallel with the bent portion 503.

That is, one end of the input connection portion 531 can be connected to the first header 53, and the other end of the input connection portion 531 can be formed at a position facing the second header 55. In addition, the input connection portion 531 can be formed to traverse the inner space in a state parallel to the bent portion 503 as a whole.

Also, the other end of the input connection portion 531 can be connected to the input pipe 54 connected to the compressor 30, a high temperature and high pressure refrigerant through the input pipe 54 can flow to the first header 53 through the input connection portion 531.

In some implementations, the input connection portion 531 may not be located in a space between the blow fan unit 60 and the condenser 50.

The output connection portion 532 can be spaced apart from the input connection portion 531 in a downward direction and can be connected to the first header 53. In addition, the output connection portion 532 extends forward from the front of the first header 53 and is formed to traverse the inner space 50*a* of the condenser 50, and the end of the output connection portion 532 can be disposed at a position facing the second header 55. That is, the output connection portion 532 can be vertically spaced apart from the input connection portion 531 and formed in parallel.

Therefore, the output connection portion 532 also extends linearly from the first header 53 toward the second header 55 and does not extend to the side of the first header 53, that is, in a direction in which the blow fan unit 60 is provided.

The output connection portion 532 extends in a direction parallel to the blow fan unit 60 from the front of the first header 53 and can be located in the inner space 50*a* of the condenser 50. In addition, the output connection portion 532 can be formed in a direction perpendicular to the first and second linear portions 501 and 502 or in a vertical direction and can be formed in parallel with the bent portion 503.

One end of the output connection portion 532 can be connected to the first header 53, and the other end of the output connection portion 532 can be connected to an output pipe 56 connected to the expansion device 74.

With this structure, the input connection portion 531 and the output connection portion 532 can be located in parallel with the blow fan unit 60 mounted on the base pan 40 in a state connected to the first header 53. In addition, since the input connection portion 531 and the output connection portion 532 are not located in the space S between the first header 53 and the blow fan unit 60, an additional space S of the machine compartment 11 can be secured. In other words, there is an advantage of increasing space efficiency of the condenser 50.

For example, referring to FIG. 8, a welding operation may be performed to fix devices such as the condenser 50 and the compressor 30 in the machine compartment 11 to the bottom plate 111 or the base pan 40. In some examples, a control valve or the like for controlling a flow of a refrigerant supplied to the evaporator can be fixed to one wall surface of the machine compartment, and then be connected to a pipe that is connected to the compressor and the evaporator by welding. Since other components such as the input connection portion 531 and the output connection portion 532 are not located in the additional space S, an operator can perform the welding operation more easily in the additional space S.

In addition, the input connection portion 531 can be connected to the first header 53 as a single input connection portion 531, or a plurality of input connection portions 531 can be connected to the first header 53. In addition, the output connection portion 532 can be connected to the first header 53 as a single output connection portion 532, or a plurality of output connection portions 532 can be connected to the first header 53.

The high-temperature and high-pressure refrigerant introduced through the input connection portion 531 can flow to the second header 55 through the plurality of tubes 51 through the first header 53. In addition, the refrigerant introduced into the second header 55 can be changed in direction by the second header 55, flow to the first header 53 by passing through the plurality of other tubes 51, and is finally directed to the expansion device 74 through the output connection portion 532 and the output pipe 56.

The tube 51 can be formed in a structure in which a plurality of channels or flow paths are continuously arranged in a horizontal direction, and both ends thereof can connect the first header 53 and the second header 55. In addition, the tubes 51 can have the same structure and shape and can be continuously arranged at regular intervals in the up-down direction along the first header 53 and the second header 55.

In some implementations, the heat exchange fins 52 can be provided in a space between the plurality of tubes 51. For example, the heat exchange fins 52 can be disposed between any two tubes among the plurality of tubes 51. The heat exchange fins 52 can be continuously bent in a zigzag shape and formed along the space between the tubes 51. Fin openings 521 are formed between bent portions of the heat exchange fins 52 and the tubes 51 as the heat exchange fins 52 are mounted. In addition, a contact region of air passing through the fin openings 521 formed by the heat exchange fins 52 can be increased, and heat exchange efficiency with the refrigerant inside the tube 51 can be increased.

Also, the tubes 51 can be inserted into the inner side of the first header to allow the refrigerant introduced through the input connection portion 531 to flow into the condenser or the refrigerant discharged from the condenser to flow into the output connection portion 532. In addition, the tubes 51 inserted into the first header and the input connection portion or output connection portion 532 connected to the first header can be arranged in a direction perpendicular to each other or vertically.

In addition, a cross-section of a portion of the tube 51 inserted into the inner side of the first header 53 can include an inclined surface inclined in a diagonal direction toward the inside of the first header 53, as shown in FIG. 7.

The cross-section of the tube 51 can be formed in an inclined shape at an angle of 30 to 60 degrees, for example. In detail, an inclined surface 511 can be formed such that a rear end 511*b* is closer to the blow fan unit 60 than a front end 511*a*, that is, a cross-section in contact with the inner space 50*a* of the condenser 50.

In other words, a point in contact with the first header 53 at the front end 511*a* of the inclined surface 511 can be spaced apart from the output connection portion 532 to one side. In addition, a point in contact with the inner side of the first header 53 at the rear end 511*b* can be located to be spaced apart from the output connection portion 532 to the rear side. That is, the inclined surface 511 can have a shape opened toward the output connection portion 532.

If the cross-section of the tube 51 accommodated inside the first header is formed horizontally, the refrigerant flowing into the first header through the tube 51 flows in the same direction as the direction in which the tube 51 extends. Thus, the refrigerant may not flow smoothly to the output connection portion 532 connected to the tube 51 in a vertical direction.

In some implementations, the inclined surface 511 is included in the cross-section of the tube 51, so that the refrigerant passing through the tube 51 effectively flows to the output connection portion 532 without loss of flow path.

Such an inclined surface 511 is not limited thereto, but can be formed on the tube 51 in communication with the output connection portion 532 or can also be formed on the tube 51 in communication with the input connection portion 531.

In some examples, the input pipe 54 connecting the condenser 50 and the compressor 30 can be bent a plurality of times, and at least part of the input pipe 54 can be disposed in the inner space 50*a* in which the condenser 50 is bent to be formed.

In detail, the input pipe 54 can include an input pipe extension portion 543 extending from the compressor 30 toward the bottom of the inner space 50*a*, a lower bent portion extending from an end of the input pipe extension portion 543 to the inner side of the base pan 40, and an upper bent portion 541 connecting an end of the lower bent portion 542 and the first header 53.

The input pipe extension portion 543 can be connected to the outlet of the compressor 30 and can extend to the bottom of the inner space 50*a*. In addition, the lower bent portion 542 can be formed by repeatedly bending the base pan 40 from the inside a plurality of times.

In addition, the upper bent portion 541 can be formed to extend upward from one end of the lower bent portion 542 and can be bent along the inner surface of the condenser 50. In addition, an end of the upper bent portion 541 can be connected to the input connection portion 531. The upper bent portion 541 is bent along the inner surface of the condenser 50 in the process of extending toward the first header 53, so that the input pipe 54 is prevented from shaking when air flows by the operation of the blow fan unit 60. In addition, the upper bent portion 541 can be disposed along the inner surface of the condenser 50 so that additional cooling can be performed by air passing through the condenser 50.

Hereinafter, a structure for mounting the condenser 50 will be described in more detail with reference to the drawings.

FIG. 8 is a plan view showing an example state in which the condenser is mounted.

In some implementations, the base pan 40 can include a bottom surface 41 formed in a plate shape and an edge 42 formed along the circumference of the bottom surface 41.

The base pan 40 can be formed to be injection-molded with a plastic material and can have a structure in which the condenser 50 and the blow fan unit 60, drain hoses 72 and 73 for discharging defrost water formed in the condenser 50 to the base pan 40, the expansion device 74, etc. can be mounted.

On the bottom surface 41 of the base pan 40, a first supporter 432 and a second supporter 431 protruding upward can be formed at positions corresponding positions where the first header 53 and the second header 55 are disposed. In addition, a first fixing portion 46 and a second fixing portion 45 can be formed on upper surfaces of the first supporter 432 and the second supporter 431, respectively. The first fixing portion 46 and the second fixing portion 45 restrain lower ends of the first header 53 and the second header 55 so that the condenser 50 is fixed to and mounted on the base pan 40.

In some examples, the second fixing portion 45 can have the same structure as the first fixing portion 46 and can protrude from an upper surface of the second supporter 431. The second fixing portion 45 can be formed higher than the first fixing portion 46 to thereby restrain the second header 55 of the condenser 50 moved forward after passing through the first fixing portion 46.

In some examples, only any one of the first fixing portion 46 and the second fixing portion 45 can be provided to fix the head of the condenser 50.

A barrier 433 forming a water collection space can be provided on the bottom surface 41 of the base pan 40. Both ends of the barrier 433 are connected to the first supporter 432 and the second supporter 431 and can extend to the side. Here, the barrier 433 can extend along a lower end of the condenser 50, thus forming a space between the first supporter 432 and the second supporter 431 in which defrost water can be guided. In addition, a pipe supporter 75 supporting the lower bent portion 542 can be provided in the water collecting space.

The blow fan unit 60 can be mounted at one end of the base pan 40 facing the compressor 30 side.

A third fixing portion 422 for fixing the bent portion 503 of the condenser 50 can be formed at a position corresponding to one side of the cabinet 10 among both sides of the base pan 40.

A fixing member 44 can be mounted on an upper surface of the third fixing portion 422. A fastening hole through which a screw 444 penetrating the fixing member 44 is fastened can be formed at the third fixing portion 422.

That is, one side surface of the condenser 50 corresponding to the bent portion 503 can be fixed by the fixing member 44. The fixing member 44 can be mounted on the third fixing portion 422 in a state in which the first header 53 and the second header 55 are fixed. By mounting the fixing member 44, the condenser 50 can be fixed at three points and a solid mounting state of the condenser 50 can be maintained.

The fixing member 44 is integrally molded with the base pan 40 and then mounted on the third fixing portion 422 in a state in which the condenser 50 is seated on the base pan 40.

In particular, the fixing member 44 can have a structure mounted through the bending portion 503 of the condenser 50 to restrain movement of the condenser 50 in the front-rear direction. Accordingly, it is possible to fundamentally prevent an unintended separation situation of the condenser 50 that can occur due to the movement mounting and separating structure of the condenser 50 in the front-rear direction.

With this structure, since the first linear portion 501, the second linear portion 502, and the bent portion 503 are fixed to the first fixing portion 46, the second fixing portion 45, and the third fixing portion 422, respectively, the condenser 50 can be maintained in a stable mounting state.

In addition, an expansion device mounting portion 423 extending upward can be formed at an edge of the base pan 40 close to the compressor 30 side. The expansion device mounting portion 423 can extend to a predetermined height, and a screw hole through which a screw penetrating the expansion device 74 is fastened can be formed at an upper end of the expansion device mounting portion 423.

What is claimed is:

1. A refrigerator comprising:

a cabinet that defines a storage space and a machine compartment therein, the machine compartment being separate from the storage space;

a compressor disposed in the machine compartment;

a condenser that is disposed in the machine compartment, the condenser being curved along front, rear, and side surfaces of the machine compartment; and a blow fan disposed between the compressor and the condenser in the machine compartment, wherein the condenser comprises:

a first header disposed at a first end of the condenser, a second header disposed at a second end of the condenser, a plurality of tubes that connect the first header and the second header to each other, a plurality of heat exchange fins that are disposed between the plurality of tubes, an input connection portion that extends from the first header toward the second header, the input connection portion being configured to supply refrigerant to the first header, and an output connection portion that extends from the first header toward the second header and is spaced apart from the input connection portion, the output connection portion being configured to receive the refrigerant discharged from the first header, wherein each of the input connection portion and the output connection portion extends parallel to the blow fan without extending toward the blow fan, and wherein parts of the input connection portion and the output connection portion extend parallel to each other.

2. The refrigerator of claim 1, wherein the condenser comprises:

a pair of linear portions that are spaced apart from each other and extends parallel to each other, the pair of linear portions comprising the first header and the second header, respectively; and a bent portion that connects the pair of linear portions to each other, and wherein the input connection portion and the output connection portion extend perpendicular to the pair of linear portions.

3. The refrigerator of claim 1, wherein the second header is disposed forward relative to the first header, and wherein the input connection portion extends forward from an upper portion of the first header toward the second header, the input connection portion being curved into an inner space defined by the plurality of tubes that are bent and connect between the first header and the second header.

4. The refrigerator of claim 1, wherein the second header is disposed forward relative to the first header, and wherein the output connection portion extends forward from a lower portion of the first header toward the second header, the output connection portion being curved into an inner space defined by the plurality of tubes that are bent and connect between the first header and the second header.

5. The refrigerator of claim 1, wherein the input connection portion has a first end connected to the first header and a second end that faces the second header.

6. The refrigerator of claim 1, wherein the output connection portion a first end connected to the first header and a second end that faces the second header.

7. The refrigerator of claim 1, wherein the condenser further comprises an upper bent portion that is connected to the input connection portion and curved away from the blow fan toward the condenser.

8. The refrigerator of claim 1, wherein the input connection portion and the output connection portion are located outside a space defined between the blow fan and the condenser.

9. The refrigerator of claim 1, further comprising an input pipe that connects the compressor to an end of the input connection portion.

10. The refrigerator of claim 1, further comprising:

an output pipe connected to an end of the output connection portion; and an expansion device connected to the output pipe.

11. The refrigerator of claim 1, wherein the plurality of tubes are inserted into the first header along a first direction, and wherein the input connection portion and the output connection portion are connected to the first header along a second direction perpendicular to the first direction.

12. The refrigerator of claim 1, wherein the plurality of tubes comprise an inclined surface that is inserted into the first header.

13. The refrigerator of claim 12, wherein the inclined surface is inclined by 30° to 60° with respect to an extension direction of the input connection portion or the output connection portion.

14. The refrigerator of claim 12, wherein a distance between a rear end of the inclined surface and the blow fan is less than a distance between a front end of the inclined surface and the blow fan.

15. The refrigerator of claim 12, wherein the inclined surface has a contact area that is in contact with an inner side of the first header, the contact area being disposed rearward relative to a rear side of the output connection portion or the input connection portion.

16. A condenser comprising:

a pair of linear portions that are spaced apart from each other and extend parallel to each other, the pair of linear portions comprising a first header disposed at a first end of the condenser and a second header disposed at a second end of the condenser;

a bent portion that connects the pair of linear portions to each other, the bent portion comprising a plurality of tubes that are bent and connect the first header and the second header to each other;

a plurality of heat exchange fins disposed between the plurality of tubes;

an input connection portion that extends from the first header toward the second header, the input connection portion being configured to supply refrigerant to the first header; and an output connection portion that extends from the first header toward the second header and is spaced apart from the input connection portion, the output connection portion being configured to receive the refrigerant discharged from the first header, wherein parts of the input connection portion and the output connection portion are located in an inner space defined by the plurality of tubes in the bent portion, and wherein parts of the input connection portion and the output connection portion extend parallel to each other.

17. The condenser of claim 16, wherein the input connection portion and the output connection portion are connected to the first header along a direction perpendicular to an extension direction of the pair of linear portions.

18. The condenser of claim 16, wherein the plurality of tubes comprise an inclined surface that is inserted into the first header.

19. The condenser of claim 18, wherein the inclined surface is inclined by 30° to 60° with respect to an extension direction of the input connection portion or the output connection portion.

* * * * *